US008894502B2

(12) United States Patent
Rose

(10) Patent No.: US 8,894,502 B2
(45) Date of Patent: Nov. 25, 2014

(54) APPARATUS FOR HOUSING TELEMETRY, SENSING, PROCESSING AND OTHER ELECTRONIC COMPONENTS AND AFFIXING SUCH APPARATUS TO A GOLF CLUB

(75) Inventor: Roger F. Rose, Cedar Park, TX (US)

(73) Assignee: SkyHawke Technologies, LLC, Ridgeland, MS (US)

( * ) Notice: Subject to any disclaimer, the term of this patent is extended or adjusted under 35 U.S.C. 154(b) by 703 days.

(21) Appl. No.: 13/232,687

(22) Filed: Sep. 14, 2011

(65) Prior Publication Data

US 2013/0065703 A1 Mar. 14, 2013

(51) Int. Cl.
*A63B 69/36* (2006.01)

(52) U.S. Cl.
CPC ..... *A63B 69/3632* (2013.01); *A63B 2220/833* (2013.01)
USPC ..... 473/223; 473/226

(58) Field of Classification Search
USPC ..... 473/221, 223, 224, 226, 231, 233
See application file for complete search history.

(56) References Cited

U.S. PATENT DOCUMENTS

| | | | | |
|---|---|---|---|---|
| 1,810,795 | A | 6/1931 | Soderquist | |
| 3,242,582 | A * | 3/1966 | Garrett | 473/226 |
| 4,017,083 | A * | 4/1977 | Johnson | 473/231 |
| 5,395,116 | A * | 3/1995 | Blaakman | 473/224 |
| 6,517,352 | B2 * | 2/2003 | Smith | 434/252 |
| 6,753,778 | B2 | 6/2004 | Kruger | |
| 7,232,376 | B2 | 6/2007 | Droppleman | |
| 7,800,480 | B1 * | 9/2010 | Joseph et al. | 340/10.1 |
| 7,883,428 | B1 * | 2/2011 | Balardeta et al. | 473/222 |
| 7,927,225 | B1 * | 4/2011 | Balardeta et al. | 473/222 |
| 7,931,544 | B2 | 4/2011 | Gill | |
| 8,272,970 | B2 * | 9/2012 | Balardeta et al. | 473/222 |
| 8,425,292 | B2 * | 4/2013 | Lui et al. | 463/3 |
| 8,444,499 | B2 * | 5/2013 | Balardeta et al. | 473/223 |
| 2005/0261073 | A1 * | 11/2005 | Farrington et al. | 473/221 |
| 2005/0288119 | A1 * | 12/2005 | Wang et al. | 473/223 |
| 2006/0058108 | A1 * | 3/2006 | Kim | 473/219 |
| 2007/0243947 | A1 | 10/2007 | Cheng | |
| 2009/0163287 | A1 | 6/2009 | Vald'Via et al. | |
| 2009/0233735 | A1 | 9/2009 | Savarese et al. | |
| 2012/0052973 | A1 * | 3/2012 | Bentley | 473/223 |
| 2012/0295726 | A1 * | 11/2012 | Cherbini | 473/222 |
| 2013/0065703 | A1 * | 3/2013 | Rose | 473/223 |
| 2013/0095941 | A1 * | 4/2013 | Bentley et al. | 473/223 |
| 2013/0203517 | A1 * | 8/2013 | Bolane et al. | 473/223 |

OTHER PUBLICATIONS

International Search Report and Written Opinion issued Nov. 27, 2012 in Application No. PCT/US2012/054739.

* cited by examiner

*Primary Examiner* — Raleigh W Chiu
(74) *Attorney, Agent, or Firm* — Oblon, Spivak, McClelland, Maier & Neustadt, L.L.P.

(57) ABSTRACT

A housing for a sensor includes the sensor; vertical walls surrounding an aperture containing the sensor; a horizontal floor connected to a bottom of the vertical walls, the floor having the sensor located thereon; and a vertical shaft connected to the bottom of the floor and configured to connect the housing to a grip of a golf club. The shaft and at least the horizontal floor define a continuous air passage to vent air pressure from an inside of the golf club to an outside of the golf club.

18 Claims, 12 Drawing Sheets

APPARATUS FOR HOUSING TELEMETRY, SENSING, PROCESSING AND OTHER ELECTRONIC COMPONENTS AND AFFIXING SUCH APPARATUS TO A GOLF CLUB

BACKGROUND OF THE INVENTION

1. Field of the Invention

The present invention relates to a housing for containing telemetry, sensing, processing and other electronic components that provide data regarding playing the game of golf. The housing can be affixed to a golf club.

2. Description of the Related Art

A good shot in the game of golf requires a golf swing with certain bio-mechanic precision. The critical components of a golf swing include, among other things, the plane on which the club is swung, the speed of the backswing and forward swing, the steepness and direction of angle of the club throughout the swing, the angle of the club face, the path of the swing as well as the body positioning of the golfer during the swing. Various devices (referred to herein as "club tags") that typically include such components as accelerometers, gyros, piezo sensors and other sensors, can be attached to a golf club and can measure and even recreate a golf swing so that it can be analyzed and improved upon.

Club tags can also detect whether a golf club has been removed from the golf bag and assist in pinpointing the location at which a club was taken out of the golf bag. This makes it easier to keep track of golf clubs and find clubs that have been left behind during play.

Additionally, club tags can also detect whether a golf swing has occurred, thus making scoring and data collection easier and less intrusive in the actual play of the game.

These applications describe club tags which collect data and provide the data to the golfer. The club tags include sensors which are contained within a housing which is affixed to the grip end of the club. In one embodiment, the housing includes a threaded shaft which is screwed into a hole in the end of the grip.

In one embodiment, the sensors collect data while a golfer takes a golf swing and then provide the data to be golfer thereafter so the golfer can improve their swing. In another embodiment, the sensors collect data based on the status of the golf club, for instance, whether the golf club is in or out of the golf bag. However, due to the stresses on the golf club during the swing, pressure within the club builds and can expel the shaft of the housing from the hole in the end of the grip.

Thus, there is a need for a club tag housing apparatus that houses the swing analysis and detection equipment and which protects the sensor equipment; securely fastens the club tag to a golf club and remains securely fastened during the rigors of the golf swing; provides a relief for pressure and vibration forces that are built up during the golf swing; and is unobtrusive to the golf swing.

SUMMARY OF THE INVENTION

A housing for sensor includes the sensor, vertical walls surrounding an aperture containing the sensor, a horizontal floor connected to a bottom of the vertical walls, the floor having the sensor located thereon, a vertical shaft connected to the bottom of the floor and configured to connect the housing to a grip of a golf club, where the shaft and at least the horizontal floor define a continuous air passage to vent air pressure from an inside of the golf club to an outside of the golf club.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
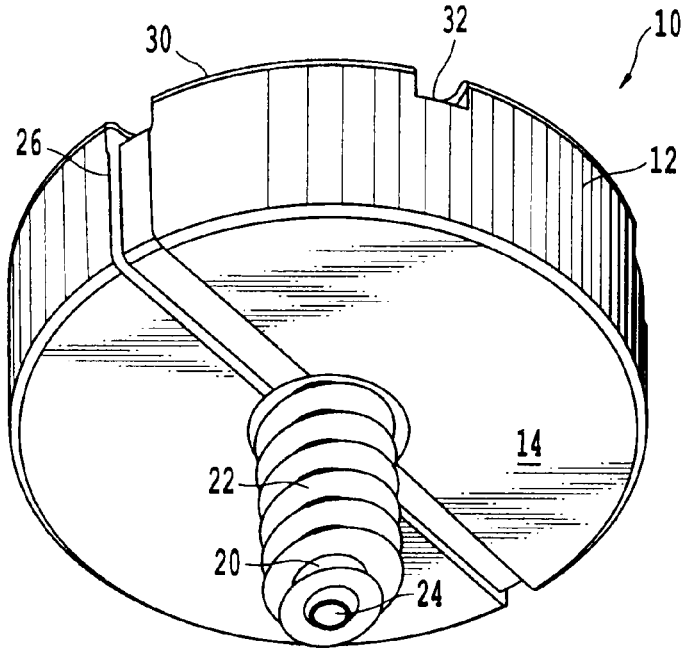
FIG. 1 shows a perspective view of a lower portion of the housing of the first embodiment of the present invention.
Figure 3:
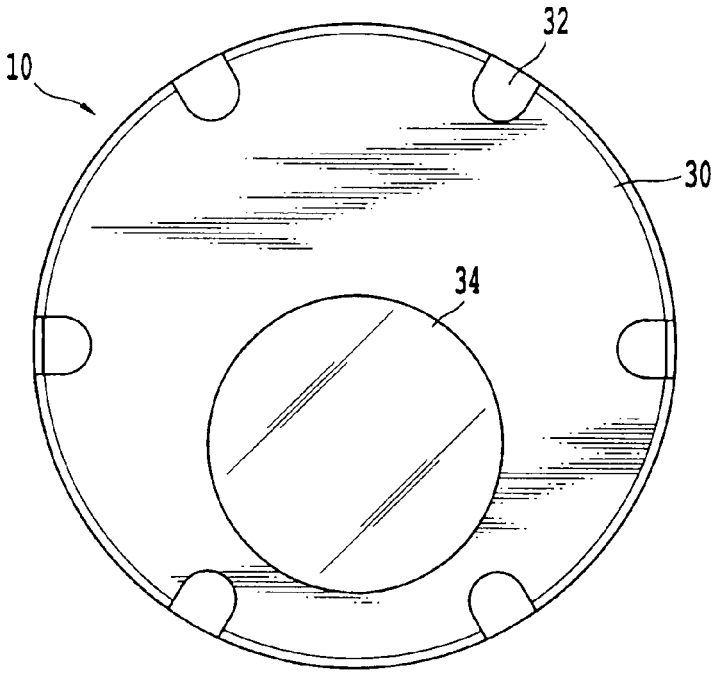
FIG. 3 shows a top view of the first embodiment of the present invention.

Referring now to the drawings, wherein like reference numerals designate identical or corresponding parts throughout the several views.

FIGS. 1-7 illustrate a first embodiment of the present invention. Housing 10 includes sidewalls 12, horizontal floor 14, and shaft 20, all of which make up a lower housing. The sidewalls 12 and horizontal floor 14 form an aperture into which a sensor (not shown in FIG. 1) is placed. In one embodiment, shaft 20 includes threads 22 for connecting housing 10 to the grip of a golf club. In this regard, housing 10 may be fully or partially recessed into the grip of the golf club, or may sit on the top surface of the grip of a golf club.

The sensor within housing 10 may include components configured to detect the status of a golf club and/or the characteristics of a swing of the golf club (e.g., photosensors, accelerometers, gyroscopes, piezos, magnetometers, etc.), process swing data (e.g., processors, micro controllers), and transmit data from the apparatus to another computing device. Details regarding these functions are described in co-pending U.S. patent application Ser. Nos. 11/548,320 and 11/548,323 and PCT Application No. PCT/US2010/55837. These applications are incorporated herein by reference in their entirety.

As shown in FIG. 1, shaft 20 also includes air passage 24 for allowing pressure that builds up inside the club to pass through the shaft 20. Air passage 24 connects with air passages 26 which allow the air to exit the club without disengaging housing 10 from the grip. As shown in FIG. 1, two air passages 26 connect to air passage 24. However, a single air passage or more than two air passages may be used within the scope of the present invention.

Further, a single, straight air passage may extend from the shaft 20 all the way through an upper housing 30. In this case, the air passage would extend through the center of the aperture which includes the sensor. In this case, the sensor would need to be arranged away from the center of the aperture. Such embodiment may include a passive sensor.

Additionally, instead of an air passage 24 through a center of shaft 20, threads 22 may include cuts to allow air to pass around the outside of shaft 20. Thus, a continuous air passage through the cuts and up to air passage 26 would allow air to pass from inside the golf club to outside the golf club without disengaging housing 10.

Housing 10 may also include upper housing 30 connected to the top of sidewalls 12 to protect the sensor. In this regard, upper housing 30 may be removable from the lower housing to expose the electronics within the lower housing, particularly the battery. The upper housing 30 may be composed of a rubber or silicon material.

Upper housing 30 may be connected to sidewalls 12 using several different methods. For example, upper housing 30 may be connected to sidewalls 12 using a cleated locking mechanism, a twist locking mechanism, or a threaded locking mechanism. Each of these locking mechanisms include a mechanical locking mechanism, such as, for example, a slotted or notched locking mechanism, that securely seats and affixes the upper housing 30 to the lower housing, while still allowing removal of upper housing 30 to access the electronics, particularly a battery for the sensor, within the lower housing.

Figure 10:
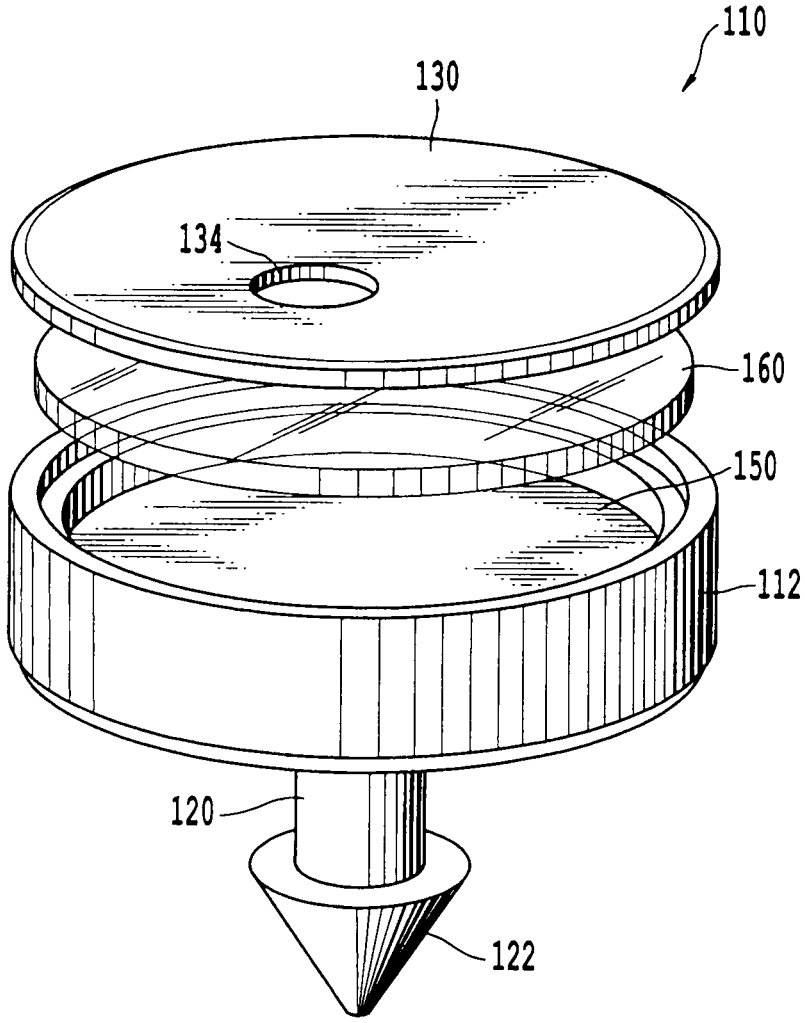
FIG. 10 shows a top perspective view of an exploded view of an additional embodiment of the present invention.

Further, a gasket may be placed between the upper housing 30 and the lower housing to more securely affix the upper housing 30 to the lower housing and to act as a barrier to water or debris entering into the aperture in the lower housing holding the electronics. In this regard, FIG. 10 shows gasket 160 located between upper housing 130 and sidewalls 112. In this embodiment, the gasket is of a material so as to allow light to pass through the gasket 160 to the light sensitive sensors 150 in the housing 110.

In another embodiment, the upper and lower housings are permanently affixed to one another. In such an embodiment, a rechargeable battery for the sensor may be used. In this regard, the lower housing may include charging pads for contact charging the battery, or inductive charging may be used to charge the battery.

Figure 2:
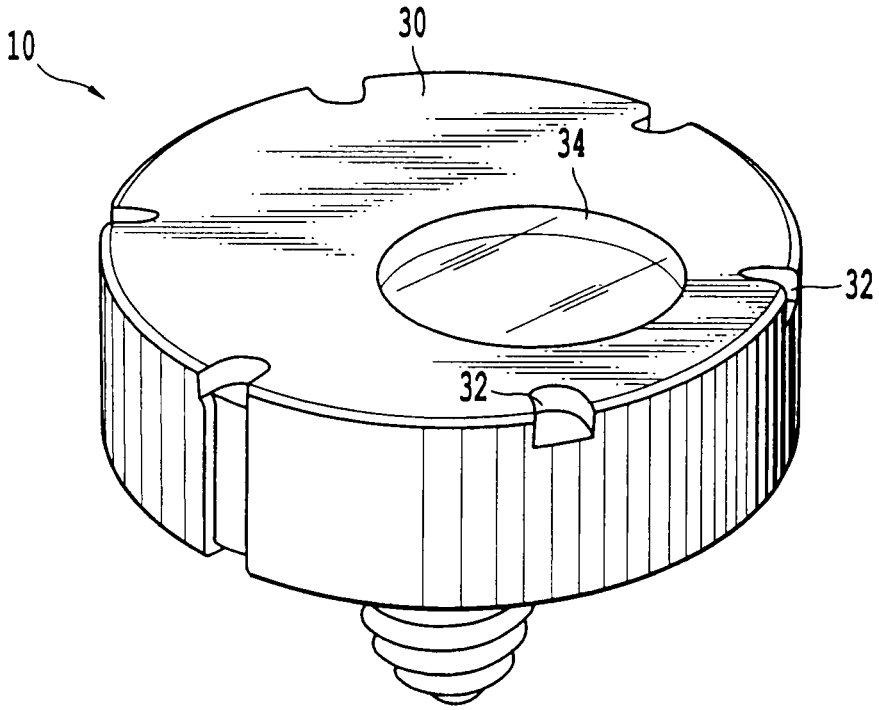
FIG. 2 shows a perspective view of upper portion of the housing of the first embodiment of the present invention.

As shown in FIG. 2, upper housing 30 includes a window 34 to allow light to enter the housing 10 such that the light impinges on the sensor within. The window 34 in FIG. 2 is an axial aperture with an axis oriented perpendicular to the upper surface of upper housing 30. In other embodiments, window 34 may have a radial or angular configuration. In the radial configuration, window 34 is located in sidewalls 12 such that light penetrates through the side of housing 10. In the angular configuration, the window 34 is located in the upper surface of upper housing 30, but an axis of the window is oriented at an angle to the upper surface of upper housing 30 to enhance light amplification or gathering.

Figure 4:
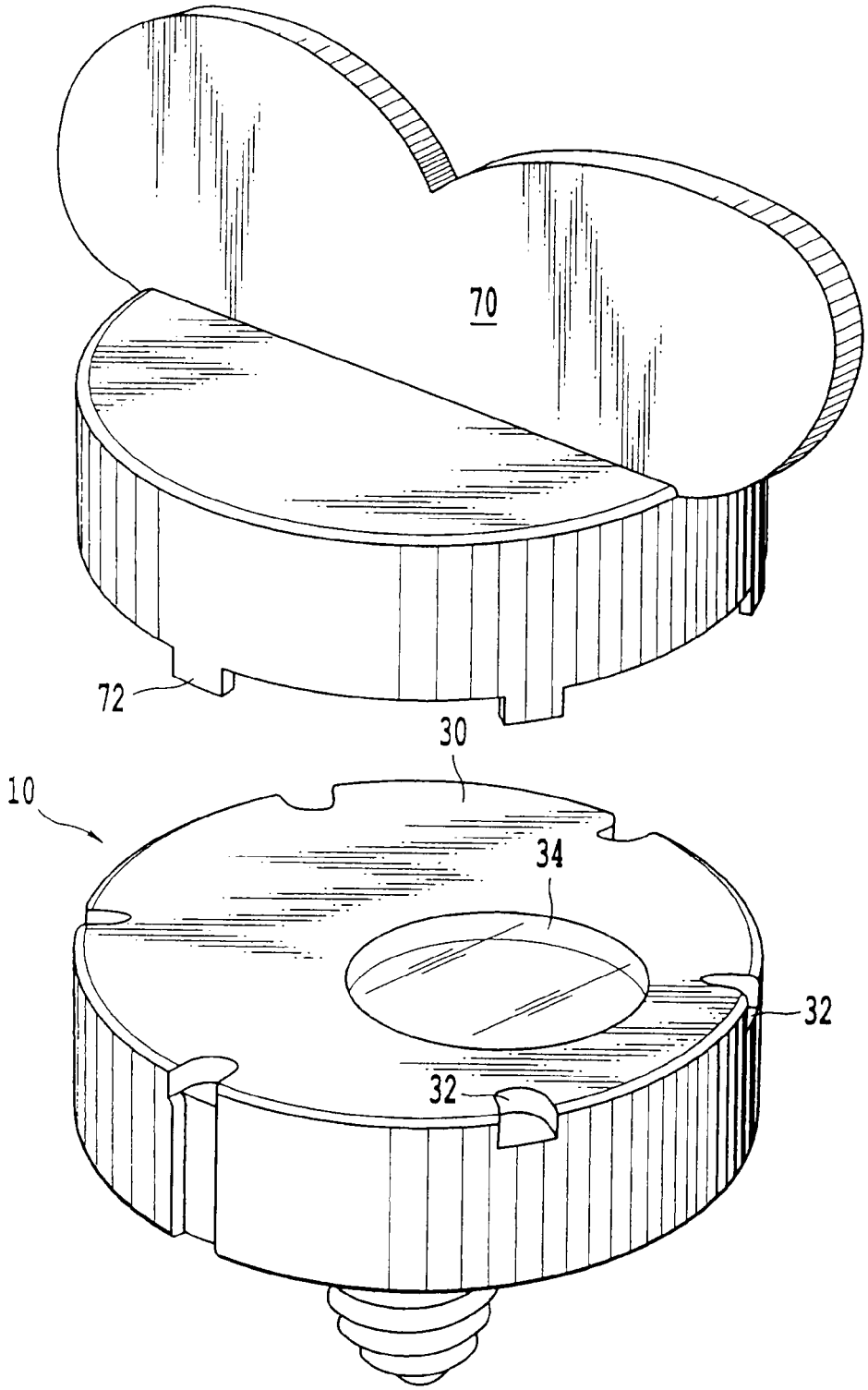
FIG. 4 shows a top perspective view of an embodiment of the present invention along with a tool for fixing the housing to a golf club.
Figure 5:
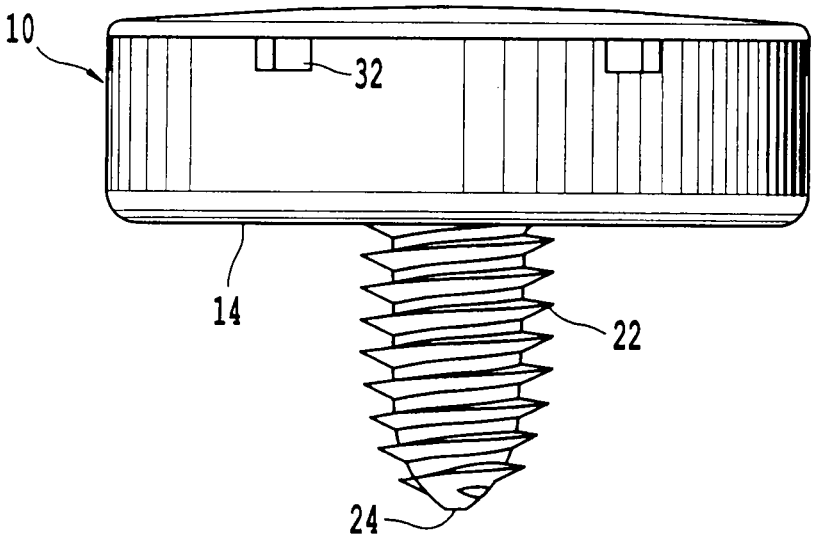
FIG. 5 shows a front view of the first embodiment of the present invention.
Figure 6:
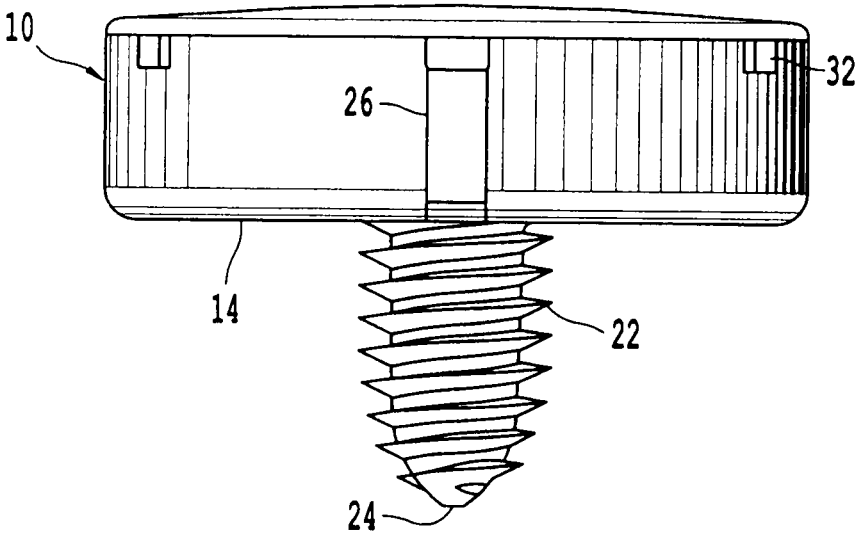
FIG. 6 shows a side view of the first embodiment of the present invention.
Figure 7:
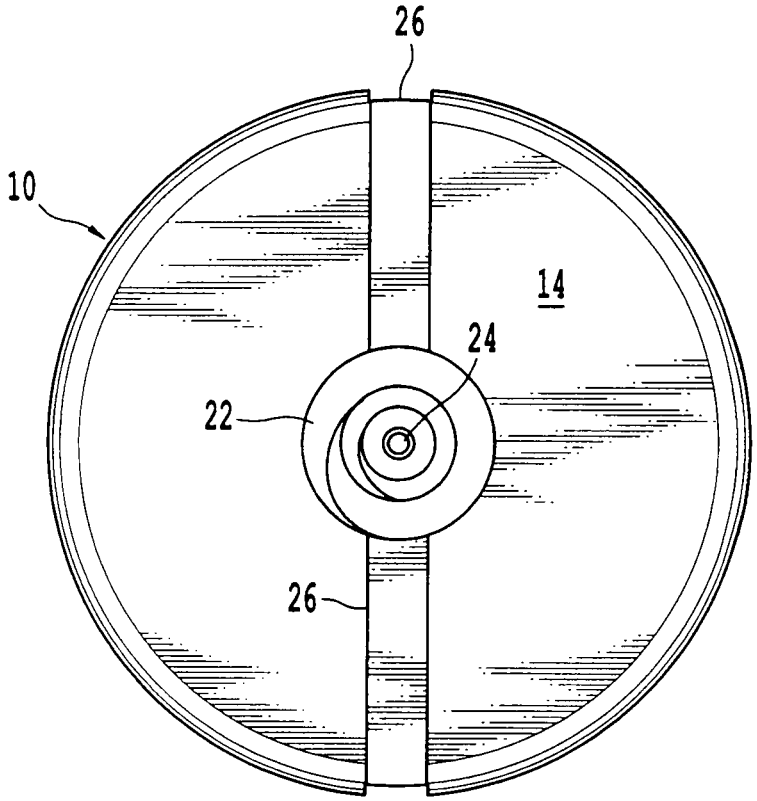
FIG. 7 shows a bottom view of the first embodiment of the present invention.

Upper housing 30 and sidewalls 12 also include apertures 32 for receiving projections 72 of tool 70, as shown in FIG. 4. Tool 70 is a custom-made tool used to attach and remove housing 10 to a golf club. Apertures 32 may be used in such manner to facilitate removal of the tag from the golf club or removal of the upper housing. Ideally, the depth of the aperture should be slightly deeper than the length of the tool projections 72 to prevent the golfer from puncturing the aperture floor by applying too much pressure on the tool. Placing apertures 32 on the perimeter of upper housing 30 has the advantage of allowing for a more rigid or robust floor to the aperture 32, thereby preventing the golfer from puncturing the aperture floor by applying too much pressure on the tool.

Figure 8:
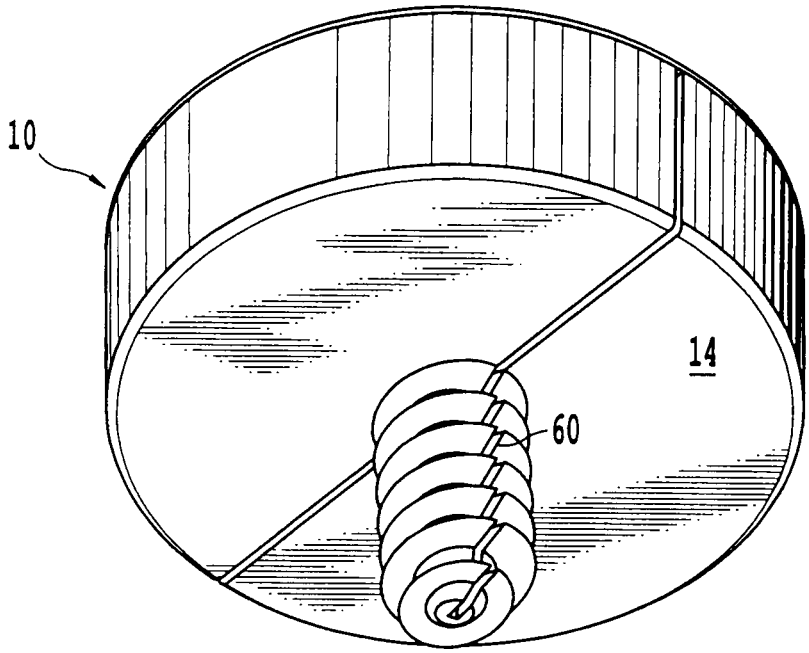
FIG. 8 shows a lower perspective view of another embodiment of the present invention.

FIG. 8 illustrates another embodiment in which the air passage for relieving pressure within the club includes passageway 60 cut through the threads on the shaft. The passageway 60 connects to the air passages running on the outside of upper housing 30.

Figure 9:
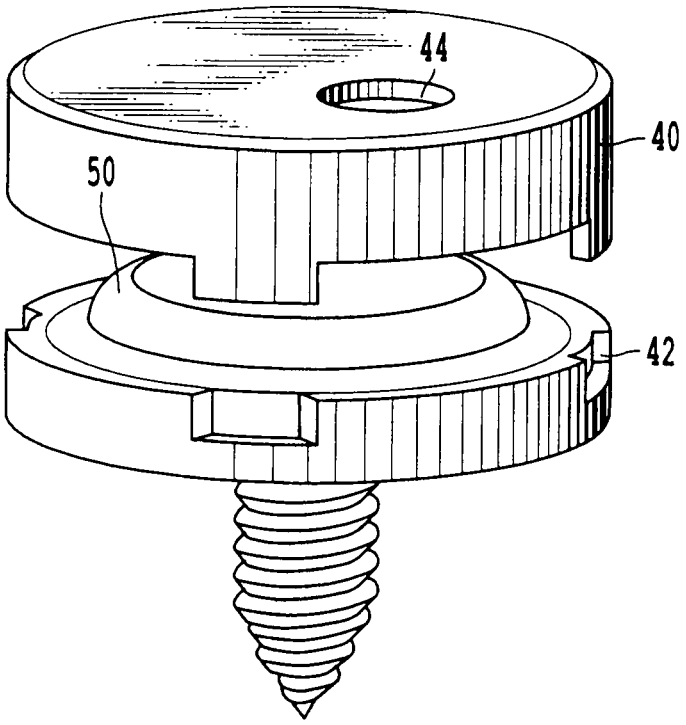
FIG. 9 shows a side perspective view of further embodiment of the present invention.

FIG. 9 illustrates another embodiment in which upper housing 40 is fixed to the lower housing using a cleated locking mechanism. In such an embodiment, cleats on upper housing 40 are received by apertures 42 with a lower housing to lock the upper housing to the lower housing. FIG. 9 also illustrates the sensor 50 beneath the window 44 in the upper housing 40.

Figure 11:
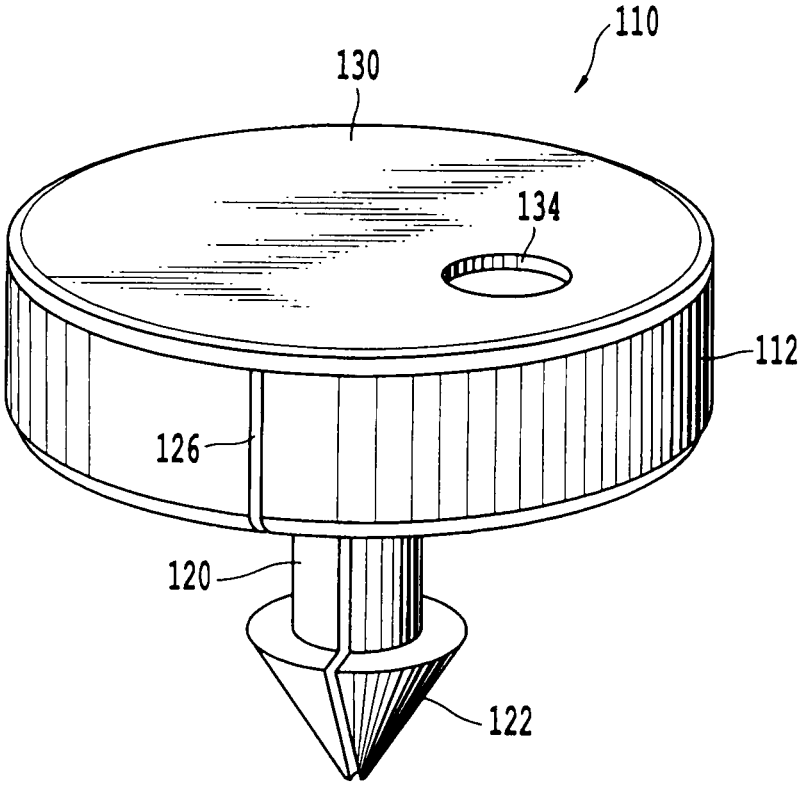
FIG. 11 shows a top perspective view of the additional embodiment of the present invention.
Figure 12:
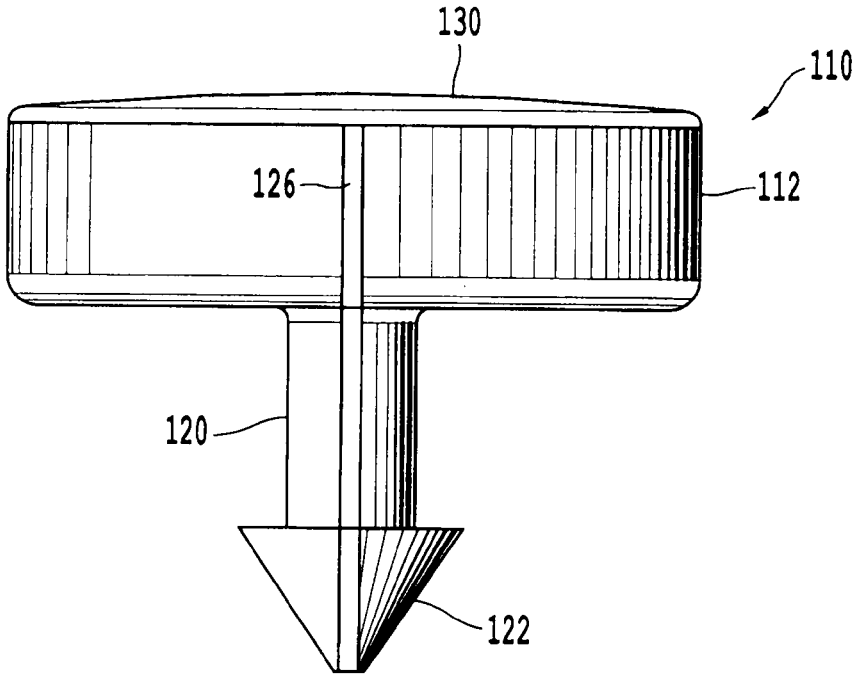
FIG. 12 shows a side view of the additional embodiment of the present invention.
Figure 13:
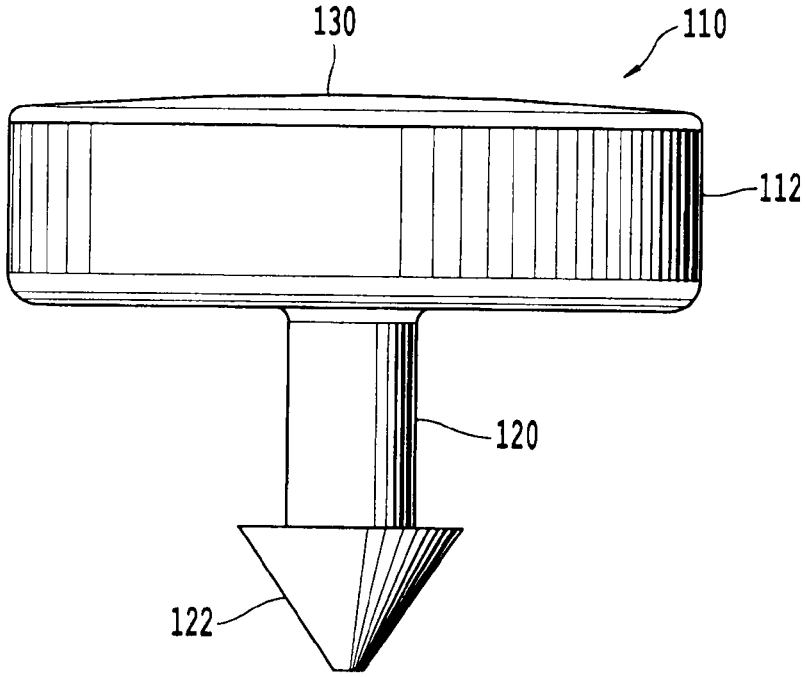
FIG. 13 shows a front view of the additional embodiment of the present invention.
Figure 14:
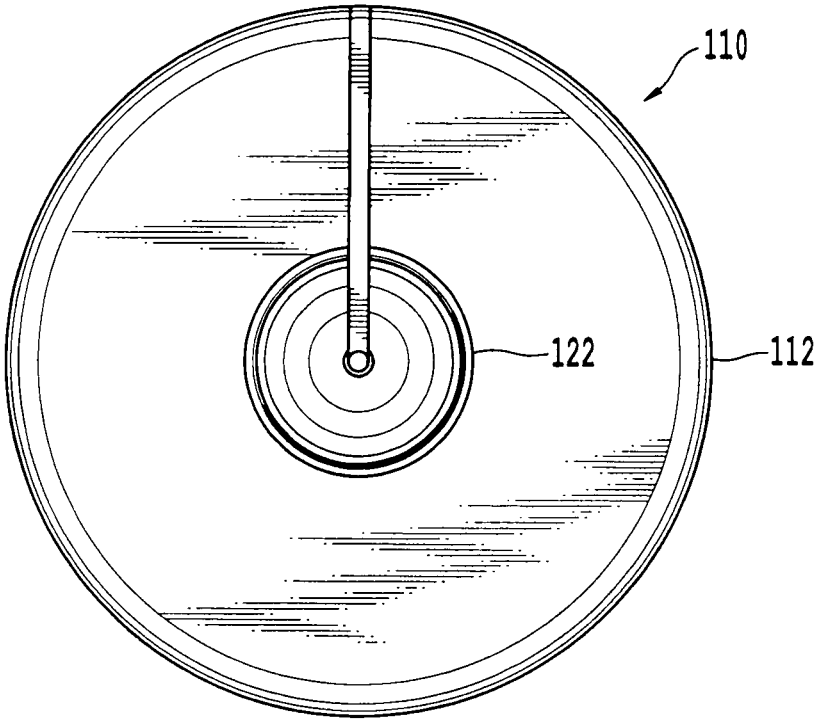
FIG. 14 shows a bottom view of the additional embodiment of the present invention.
Figure 15:
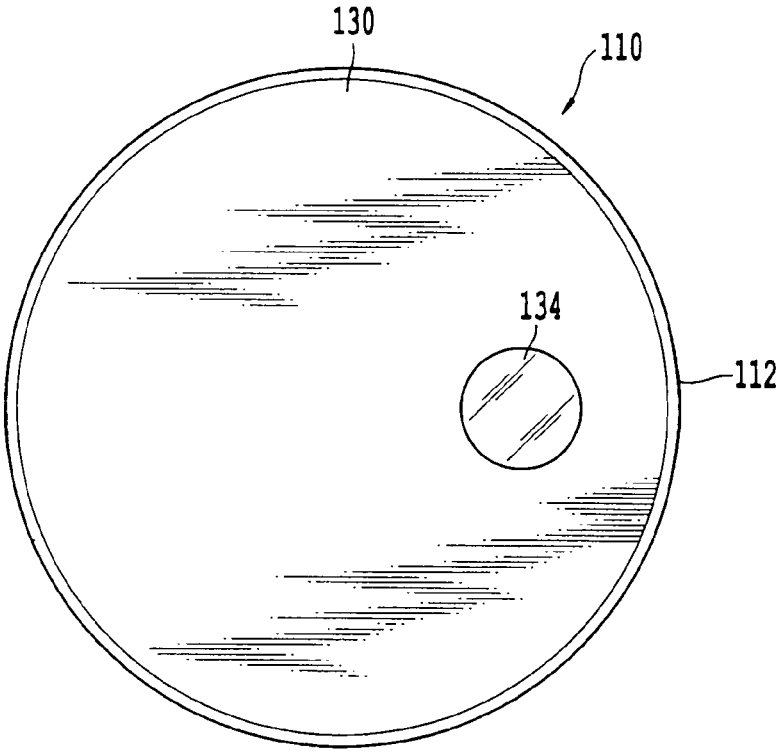
FIG. 15 shows a top view of the additional embodiment of the present invention.

FIGS. 10-15 show an additional embodiment in which shaft 120 of the lower housing includes a spiked extension 122 for fixing the housing 110 to a golf club. Alternatively, the shaft 120 may include two or more spiked extensions. Spike extension 122 is inserted into a hole in the club grip to attach the housing 110 to the grip. FIG. 10 also shows sensor 150 beneath gasket 160 and upper housing 130. Further, the additional embodiment may include air passage 126 to relieve pressure within the club, as shown in FIG. 11.

Figure 16:
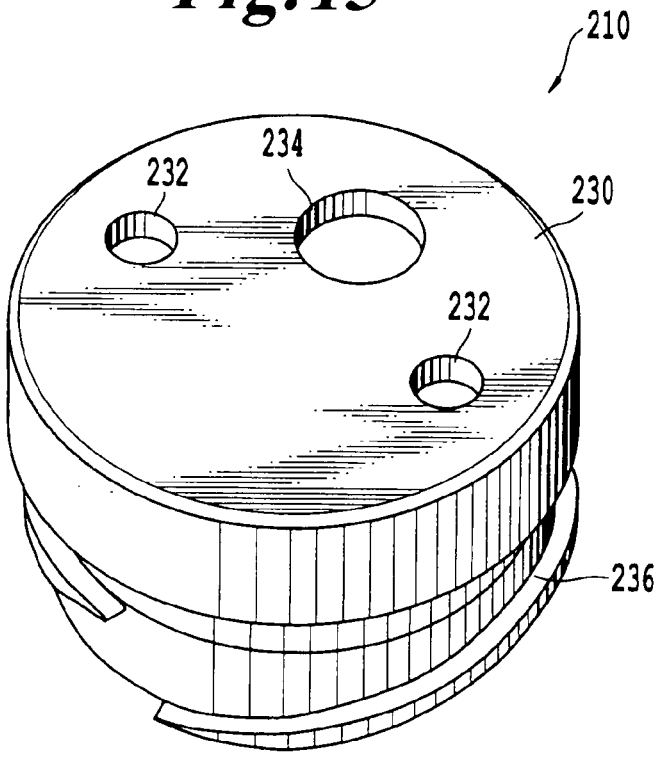
FIG. 16 shows a top perspective view of an alternative embodiment of the present invention.

FIG. 16 depicts an embodiment which uses a golf shoe cleat tool to attach and remove the upper housing to and from the golf club. This allows window 234 to be located in a center portion of the upper housing. Thus, FIG. 16 shows upper housing 230 includes apertures 232 away from the edge of the upper housing. As golf players may already own such a golf shoe cleat tool, housing 210 will not require players to obtain any new equipment to add or remove housing 210 from their golf clubs. Ideally, in such an embodiment, the depth of the aperture should be slightly deeper than the length of the tool projections to prevent the golfer from puncturing the aperture floor by applying too much pressure on the tool. FIG. 16 also shows threads 236 on the lower housing which allow upper housing to be screwed on the lower housing.

Obviously, numerous modifications and variations of the present invention are possible in light of the above teachings. It is therefore to be understood that within the scope of the appended claims, the invention may be practiced otherwise than as specifically described herein.

The invention claimed is:

1. A housing for a sensor comprising:

the sensor;

vertical walls surrounding an aperture containing the sensor;

a horizontal floor connected to a bottom of the vertical walls, the floor having the sensor located thereon; and a vertical shaft connected to the bottom of the floor and configured to connect the housing to a grip of a golf club, wherein the shaft and at least the horizontal floor define a continuous air passage to vent air pressure from an inside of the golf club to an outside of the golf club.

2. The housing according to claim 1, wherein an outer surface of the vertical shaft has threads thereon.

3. The housing according to claim 2, wherein the continuous air passage runs through cuts in the threads on the vertical shaft.

4. The housing according to claim 1, wherein the vertical shaft includes at least one rib configured to lock the housing to the grip of the golf club.

5. The housing according to claim 1, wherein the continuous air passage runs through a center of the vertical shaft.

6. The housing according to claim 1, wherein the continuous air passage runs along an outer surface of the horizontal floor and the vertical walls.

7. The housing according to claim 6, wherein two air passages run along the outer surface of the horizontal floor and the vertical walls on opposite sides of the housing.

8. The housing according to claim 1, wherein the sensor is an active sensor.

9. The housing according to claim 1, further comprising:

an upper housing configured to connect to the vertical walls and cover the aperture containing the sensor.

10. The housing according to claim 9, wherein the upper housing includes a twist locking mechanism to connect the upper housing to the vertical walls.

11. The housing according to claim 9, wherein the upper housing includes a cleated locking mechanism to connect the upper housing to the vertical walls.

12. The housing according to claim 9, wherein the upper housing includes a threaded locking mechanism to connect the upper housing to the vertical walls.

13. The housing according to claim 9, wherein the upper housing further includes apertures configured to receive a tool for rotating the upper housing to connect the upper housing to the vertical walls.

14. The housing according to claim 13, wherein the tool is a golf shoe cleat tool.

15. The housing according to claim 9, wherein the upper housing further includes a lens configured to allow light to pass through the upper housing and contact the sensor.

16. The housing according to claim 9, further comprising:

a gasket located between the upper housing and the vertical walls and configured to prevent water or debris from entering the aperture.

17. The housing according to claim 9, wherein the upper housing is permanently fixed to the vertical walls.

18. The housing according to claim 9, further comprising:

a rechargeable battery located in the aperture with the sensor.

* * * * *